US007654258B2

(12) United States Patent
Negandhi et al.

(10) Patent No.: US 7,654,258 B2
(45) Date of Patent: Feb. 2, 2010

(54) KITCHEN VENTILATION HOOD APPARATUS

(75) Inventors: Dipak J. Negandhi, Brandon, MS (US); Joseph W. Dvorak, Alma, MI (US); James William Ervin, Lake Isabella, MI (US); Mark DeLorenzo, Rosebush, MI (US)

(73) Assignee: Unified Brands, Inc., Jackson, MS (US)

( * ) Notice: Subject to any disclaimer, the term of this patent is extended or adjusted under 35 U.S.C. 154(b) by 0 days.

(21) Appl. No.: 11/749,861

(22) Filed: May 17, 2007
(Under 37 CFR 1.47)

(65) Prior Publication Data

US 2008/0135042 A1 Jun. 12, 2008

Related U.S. Application Data

(60) Provisional application No. 60/821,152, filed on Aug. 2, 2006.

(51) Int. Cl.
*F24C 15/20* (2006.01)

(52) U.S. Cl. ..... 126/299 D; 126/300; 126/312; 126/299 R; 126/299 E; 454/67; 454/188; 454/49

(58) Field of Classification Search ..... 126/299 D, 126/299 R, 299 E, 300, 312; 55/DIG. 36; 454/188, 25, 49, 50, 56, 65, 67; 96/303, 96/240; 118/326, DIG. 7; 110/125; D23/372
See application file for complete search history.

(56) References Cited

U.S. PATENT DOCUMENTS

D179,237 S 11/1956 Bernstein
2,807,994 A 10/1957 Bernstein
3,064,551 A 11/1962 Stalker
3,221,635 A 12/1965 Hill, Jr.
3,731,462 A 5/1973 Costarella et al.
3,880,062 A 4/1975 Culpepper, Jr. et al.
3,943,836 A * 3/1976 Kuechler ..... 126/299 D
4,038,912 A 8/1977 Kuechler
4,088,123 A 5/1978 Bowen, Jr. et al.
4,120,290 A 10/1978 Bowen, Jr. et al.
4,122,835 A 10/1978 Bowen, Jr. et al.
4,286,572 A * 9/1981 Searcy et al. ..... 126/299 D
4,372,195 A * 2/1983 Dorius ..... 454/66
4,700,688 A * 10/1987 Searcy et al. ..... 126/299 D
4,738,244 A 4/1988 Welsh
4,811,724 A 3/1989 Aalto et al.

(Continued)

*Primary Examiner*—Steven B McAllister
*Assistant Examiner*—Avinash Savani
(74) *Attorney, Agent, or Firm*—Butler, Snow, O'Mara Stevens & Cannada PLLC

(57) ABSTRACT

The present invention provides a kitchen ventilation hood for ventilating the area above a cooking area and for exhausting air containing cooking by-products from a cooking station to an external environment through an exhaust duct while using a reduced airflow. The kitchen ventilation hood of the present invention is designed to minimize the required airflow through the hood in order to thoroughly evacuate the cooking by-products. The kitchen ventilation hood of the current invention has a structure incorporating an arched interior hood surface that directs the air to be ventilated through the air intake gap and the grease filter. The more efficient airflow resulting from the arched interior hood surface allows for removal of cooking by-products with a lower airflow than that required by currently available ventilation hoods. As such, the kitchen ventilation hood of the present invention represents a significant improvement over prior ventilation hoods.

4 Claims, 4 Drawing Sheets

U.S. PATENT DOCUMENTS 4,822,385 A 4/1989 Strege et al.
4,854,949 A 8/1989 Giles, Sr. et al.
4,902,316 A 2/1990 Giles, Sr. et al.
4,903,685 A 2/1990 Melink
D309,659 S 7/1990 Welsh
D315,204 S 3/1991 Fleming et al.
5,154,161 A 10/1992 Rogers et al.
5,320,088 A * 6/1994 Nester ..... 126/299 D
5,394,861 A 3/1995 Stegmaier
5,467,761 A 11/1995 Kuechler
5,470,365 A * 11/1995 Jang ..... 55/510
5,472,342 A 12/1995 Welsh, II et al.
5,522,377 A 6/1996 Fritz
5,662,097 A 9/1997 Panos
5,671,726 A 9/1997 Hsu
5,713,346 A 2/1998 Kuechler
D392,380 S 3/1998 Schrank et al.
5,755,214 A 5/1998 Lai
5,842,464 A 12/1998 Koch
6,058,929 A 5/2000 Fritz
6,079,407 A 6/2000 Lai
6,196,214 B1 * 3/2001 Van Niekerk ..... 126/299 D
6,214,073 B1 * 4/2001 Chiang et al. ..... 55/385.1
6,223,741 B1 5/2001 Panos
6,235,090 B1 5/2001 Bernstein et al.
6,283,117 B1 9/2001 Chiang
6,293,983 B1 * 9/2001 More ..... 55/486
6,336,451 B1 * 1/2002 Rohl-Hager et al. .... 126/299 D
6,443,144 B1 9/2002 Van Niekerk
D473,297 S 4/2003 Bothe et al.
6,561,181 B2 5/2003 Tseng et al.
6,626,972 B2 * 9/2003 Chiang et al. ..... 55/418
6,782,885 B1 8/2004 Chiang et al.
6,802,311 B1 10/2004 Yeung
6,851,421 B2 2/2005 Livchak et al.
6,899,095 B2 5/2005 Livchak et al.
6,913,014 B2 7/2005 Chiang
6,926,000 B2 8/2005 Yeung
6,994,743 B2 2/2006 Brownell et al.
7,034,269 B2 4/2006 Jeong
2002/0083943 A1 * 7/2002 Chang ..... 126/299 D
2006/0196498 A1 9/2006 Yeung
2007/0056578 A1 * 3/2007 Aviles ..... 126/299 D

* cited by examiner

KITCHEN VENTILATION HOOD APPARATUS

CROSS REFERENCE RELATED TO PATENT APPLICATION

This application claims the benefit of U.S. Ser. No. 60/821,152 filed Aug. 2, 2006 under 35 U.S.C. § 1.119(e) (hereby specifically incorporated by reference in its entirety)

FIELD OF THE INVENTION

The present invention relates generally to ventilation hoods and more specifically to an apparatus and system for safely and efficiently ventilating the area above a stovetop or similar cooking device.

BACKGROUND OF THE INVENTION

Cooking creates undesirable by-products, such as heat, steam, grease, odors, and by-products of gas combustion used to heat the appliances. These cooking by-products pollute the air in a home or commercial environment if they are not safely removed. These cooking by-products are irritating, harmful and potentially hazardous. Accordingly, a multitude of ventilation systems have been developed to draw the cooking by-products away from the immediate vicinity of the cooking area and to expel this contaminated air to an external environment through an exhaust duct.

The heat generated from cooking expands the air in the cooking area and it rises, carrying with it the cooking by-products. Typical ventilation systems use a hood placed above the cooking area to capture the by-products prior to removal by a blower system. The hood is like a small room wherein too much airflow is as harmful as too little. If too much air is removed from a well insulated building, a negative pressure results rendering the ventilation system ineffective unless expensive make-up air is introduced. This can be a waste of heated or air conditioned air which must be replaced by heating and air conditioning systems. Most current systems have angular interior surfaces which do not adequately direct air flow, resulting in a large necessary amount of airflow through kitchen ventilation hoods to adequately remove offending substances and a waste of conditioned kitchen air. This resulting inefficiency increases the owner's utility bills and needlessly wastes energy. These deficiencies constitute a technical problem to be solved.

SUMMARY OF THE INVENTION

The present invention provides a kitchen ventilation hood for ventilating the area above a cooking area and for exhausting air containing cooking by-products and products of gas combustion from a cooking station to an external environment through an exhaust duct while using a reduced airflow.

The kitchen ventilation hood of the present invention is designed to minimize the required airflow through the hood in order to thoroughly evacuate the cooking by-products and products of gas combustion. The kitchen ventilation hood of the current invention solves the aforementioned technical problems by providing a structure incorporating an arched interior hood surface that directs the air to be ventilated through the air intake gap and the grease filter. The more efficient airflow resulting from the arched interior hood surface allows for removal of cooking by-products and products of gas combustion with a lower airflow than that required by currently available ventilation hoods. As such, the kitchen ventilation hood of the present invention represents a significant improvement over prior ventilation hoods.

The kitchen ventilation hood of the present invention incorporates a hood containing an arched interior hood surface and a front baffle. The hood is of sufficient size and design to hold the cooking by-products and products of gas combustion prior to evacuation from the hood. The hood may also have the features of curved front corners of the front baffle, one or more selectively formed flanges on the front baffle, one or more selectively formed flanges at the side baffles with most effective bend angles, or some combination thereof, to reduce the escape of any cooking by-products and products of gas combustion from the front corners of the hood, and hinges allowing for easy opening of the front baffle and access to the grease filter behind it.

BRIEF DESCRIPTION OF THE DRAWINGS

A more complete appreciation of the present invention and many attendant advantages thereof will be readily understood by reference to the following detailed description of the invention when considered in connection with the accompanying drawings.

In the drawings, FIG. 1 discloses a partial side view of the kitchen ventilation hood of this invention.

DETAILED DESCRIPTION OF THE PREFERRED EMBODIMENT OF THE INVENTION

Figure 1:
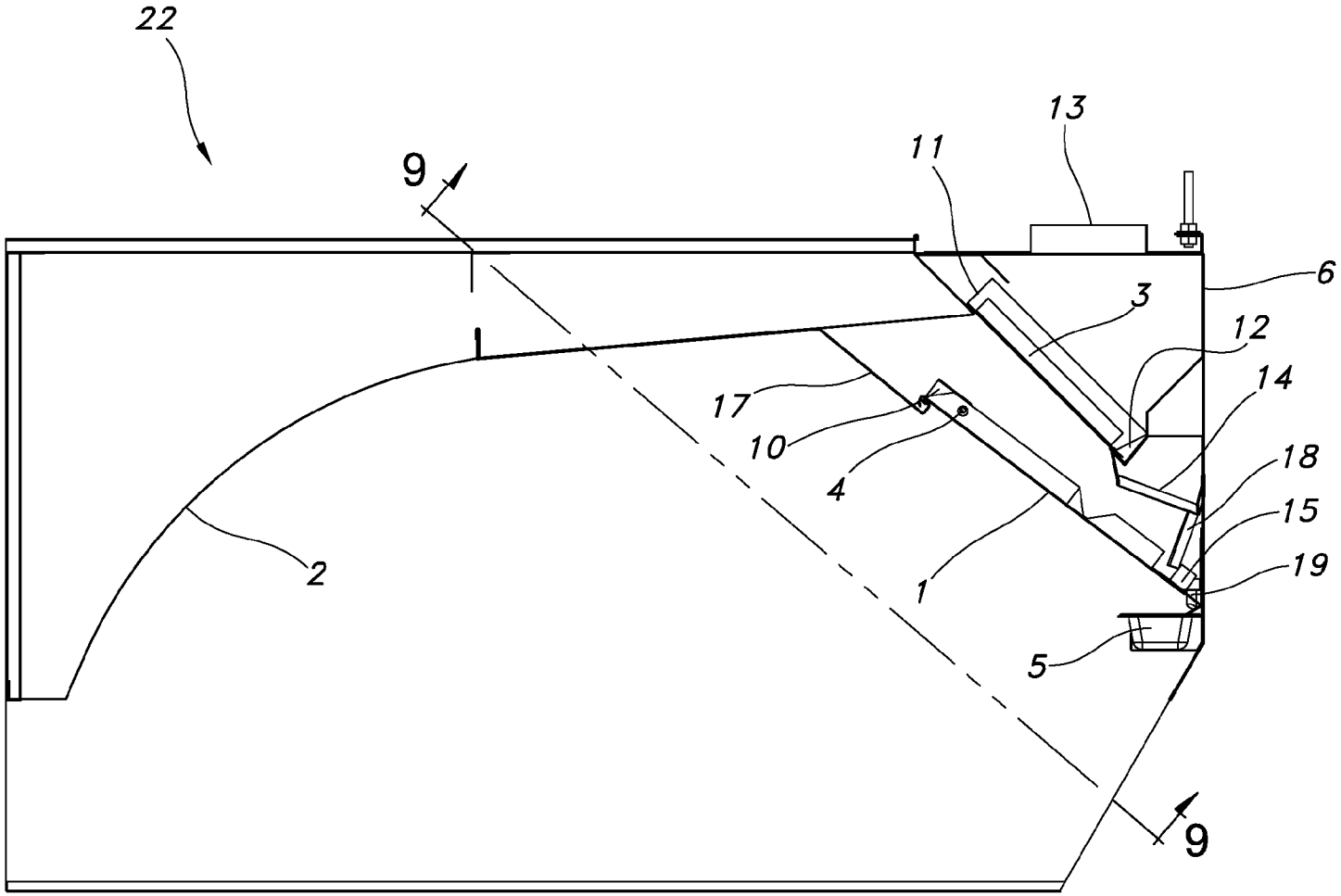
Figure 2:
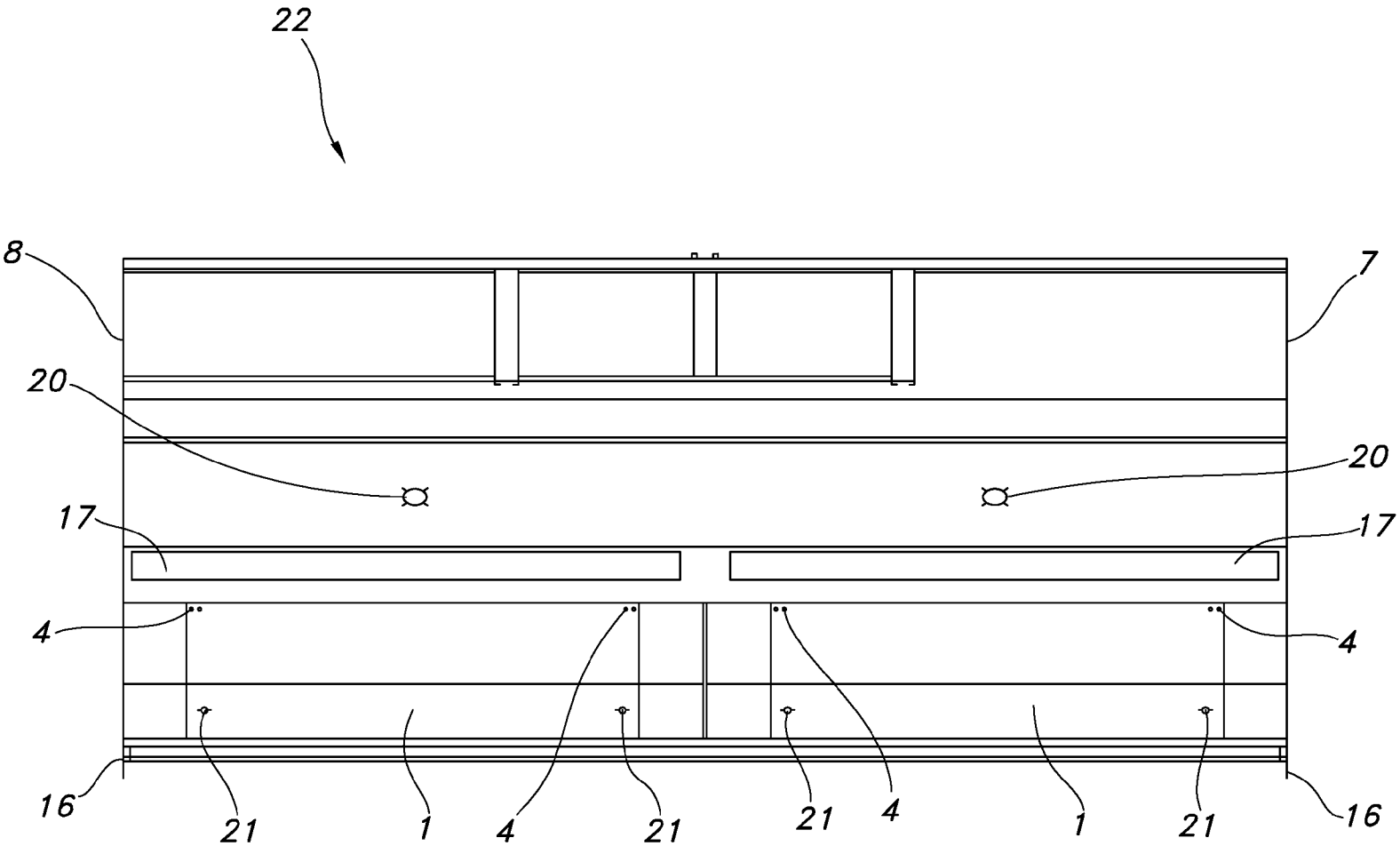
FIG. 2 provides a sectional view, taken towards the front baffle 1 along line 9-9 of FIG. 1 with grease drain cup 5 removed showing the preferred structure for the air intake gap 17 and the curved front end comers 16 of the front baffle 1.
Figure 3:
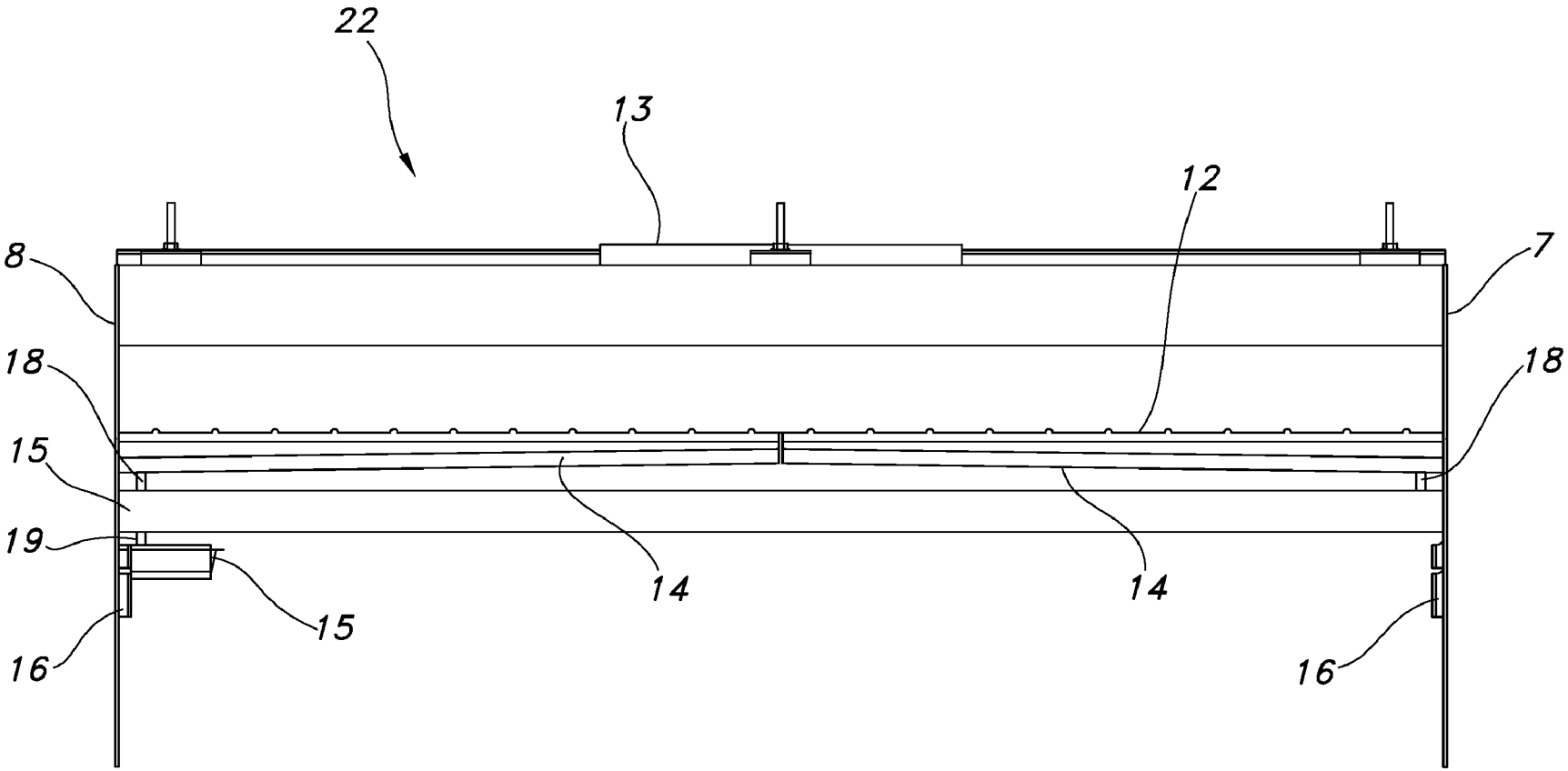
FIG. 3 provides a front view of the kitchen ventilation hood of FIG. 1 with the front shield 6 removed to show interior structure.
Figure 4:
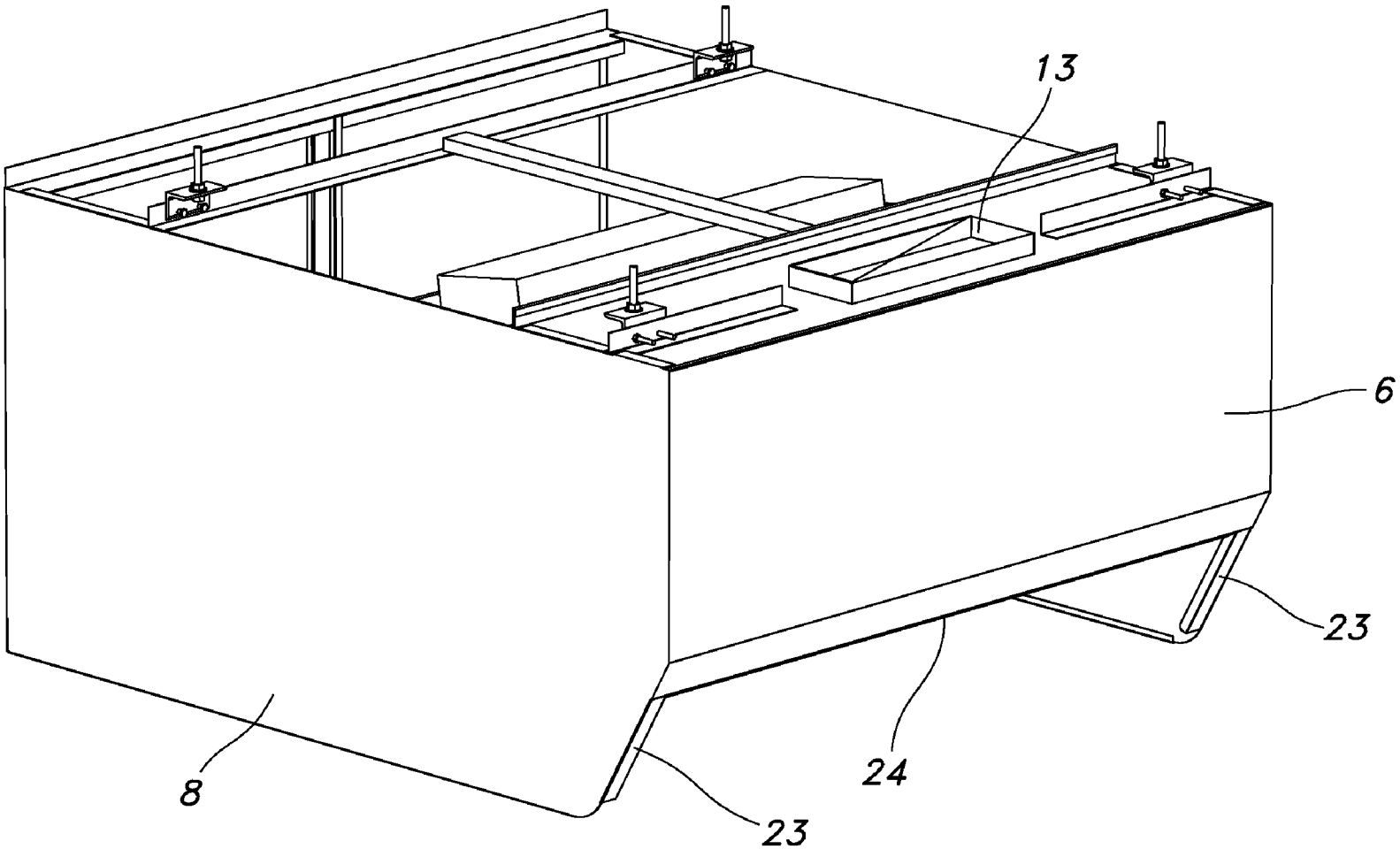
FIG. 4 provides a perspective view of the kitchen ventilation hood of FIG. 1 from above the hood to the left showing the front shield 6, the left side shield 8, and the top of the hood with the exhaust duct connection site 13 to show the location of the front flange 24 and side flanges 23 in a preferred embodiment of the invention.

In referring to the drawings, in particular the FIGS. 1, 2, 3, and 4 there is shown a kitchen ventilation hood 22 of this invention, which is designed to efficiently remove products of gas combustion and grease and/or steam vapors emanating from a cooking surface while minimizing air flow to keep clean conditioned air from being drawn from the kitchen. The kitchen ventilation hood 22 has a housing made of front shield 6, right side shield 7, and left side shield 8. The back interior surface of the kitchen ventilation hood 22 in the preferred embodiment is an arched interior hood surface 2. This arched interior surface design allows for a decreased air flow, while still removing the steam vapors and products of gas combustion from the area of the cooking surface (not shown). A front baffle 1 is provided and above the front baffle is the air intake gap 17, through which the air to be ventilated passes when exiting the kitchen ventilation hood 22. Air to be ventilated enters through the lower opening, defined as the area between the arched interior hood surface 2 and the front baffle 1, passes through the air intake gap 17, then through the grease filter 3 and finally through the exhaust duct connection site 13, through which the air passes through an exhaust duct, which may be connected to a fan that pulls the vented air away from the kitchen ventilation hood 22. When the air to be ventilated passes through the grease filter 3, grease particles in the air to be ventilated collect in the grease filter 3. That grease then drips down the grease filter 3, into the upper grease drain trough 14. In the preferred embodiment of the invention, the upper grease drain trough 14 is sloped either toward one side in a more narrow hood or to both sides in a wider hood, the grease arriving at the edges of upper grease drain trough 14, flows through the upper grease drain tube or tubes 18, which connects the upper grease drain trough 14 to the lower grease drain trough 15. The lower grease drain trough 15 is also sloped in such a manner as to bring the grease to one or both of the edges where the grease flows through the lower grease drain tube or tubes 19 into the grease drain cup 5. The user of the kitchen ventilation hood 22 can remove grease drain cup 5 from the kitchen ventilation hood 22 for cleaning and to empty the grease drain cup 5. The grease filter 3 is supported by an upper filter support 11 and a lower filter support 12.

In a preferred embodiment of the invention, the front baffle 1 has a hinges 4 by which the front baffle 1 may be opened, allowing the user access from the front to the grease filter 3, which allows for easy change of the grease filter 3 when such change is necessary. The hinges 4 on the front baffle 1, when provided, are supported by brackets 10 connected to the air intake gap 17. Handles are attached at holes 21 in the front baffle 1 to allow for easy opening of the front baffle 1.

In one preferred embodiment of the invention, the air intake gap 17 may be provided with strips of metal forming brackets 10 supporting the hinges 4 and the front baffle 1. In another preferred embodiment, the air intake gap 17 may be supported by a single sheet of metal with large holes of any shape, including rectangular, a rectangle with taper at top or bottom edge, trapezoidal, oval, or hexagonal, therein allowing for air to flow through the air intake gap 17. In addition, additional air intake gap openings, not shown, may be provided anywhere along the front baffle 1.

In another preferred embodiment of the invention, the front lower corners of the front baffle 1 are curved, forming radiuses 16. The formation of these radiuses 16 provides for better air flow through the kitchen ventilation hood 22 and lowers the chances of any air to be ventilated escaping at the comers of the kitchen ventilation hood 22.

In another preferred embodiment, the kitchen ventilation hood 22 may include a light fixture, which may be attached at openings 20 in the arched interior hood surface 2.

In another preferred embodiment, the bottom of the front shield 6 has a front flange 24 along the width of the unit, and the bottoms of the front edges of the left side shield 8 and the right side shield 7 have side flanges 23 curving inward to further optimize the airflow of the kitchen ventilation hood 22 and minimize air leakage at the edges of the kitchen ventilation hood 22.

The current preferred embodiment of the invention can be of any width, height, or depth to accommodate any width or depth of cooking surface and ceiling height. It should be understood that the foregoing represents merely an exemplary embodiment of the present invention and that various changes and modifications can be made in the arrangements and details of construction of the elements described and shown herein without departing from the spirit and scope of the present invention.

The invention claimed is:

1. A kitchen ventilation hood apparatus comprising:

a. a housing having at least a front shield, a right side shield and a left side shield;

b. an arched interior hood surface;

c. a lower opening by which air to be ventilated enters the hood having a front lower edge and a rear lower edge which are substantially the same height and a right lower edge and a left lower edge which are also substantially the same height and lower than said front lower edge and rear lower edge wherein said front lower edge is defined by the bottom edge of said front shield;

d. a front baffle extending from said front shield, said front baffle having a first face facing the lower opening and an opposite and second face facing a filter;

e. an air intake gap, between the top of said front baffle and a part of said arched interior hood surface, through which air can pass;

f. an exhaust duct connection site through which ventilated air exits said kitchen ventilation hood; and g. at least one filter support, wherein said exhaust duct connection site is positioned such that air exiting the filter placed in said at least one filter support travels directly to said exhaust duct connection site unimpeded by sharp turns or small spaces.

2. The kitchen ventilation hood of claim 1 further comprising:

a. at least one hinge located at one edge of said front baffle, allowing for the opening of said front baffle to provide access to the contents behind said front baffle.

3. The kitchen ventilation hood of claim 1 wherein said front baffle has front edges which are curved where they meet said right side shield and said left side shield.

4. The kitchen ventilation hood of claim 1 wherein said right side shield and left side shield have front edges further comprising a front flange along the width of the bottom edge of said front shield and side flanges along the bottom portion of the front edges of said left side shield and said right side shield.

* * * * *